US007541797B2

(12) United States Patent
Dequina et al.

(10) Patent No.: US 7,541,797 B2
(45) **Date of Patent: *Jun. 2, 2009**

(54) CONTROL OF A DC POWER SUPPLY

(75) Inventors: Noel B. Dequina, Flemington, NJ (US); Robert H. Isham, Flemington, NJ (US)

(73) Assignee: Intersil Americas Inc., Milpitas, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/041,499

(22) Filed: Mar. 3, 2008

(65) Prior Publication Data

US 2008/0164857 A1 Jul. 10, 2008

Related U.S. Application Data

(63) Continuation of application No. 11/423,479, filed on Jun. 12, 2006, now Pat. No. 7,345,465.

(51) Int. Cl.
*G05F 3/10* (2006.01)
*G05F 1/40* (2006.01)

(52) U.S. Cl. ..... 323/316; 323/280; 323/281

(58) Field of Classification Search ..... 323/312, 323/313, 314, 315, 316, 280, 281
See application file for complete search history.

(56) References Cited

U.S. PATENT DOCUMENTS

| | | | | |
|---|---|---|---|---|
| 6,002,276 | A | 12/1999 | Wu | |
| 6,066,944 | A | 5/2000 | Sakurai | |
| 6,351,110 | B1 | 2/2002 | Pappalardo et al. | |
| 7,345,465 | B2 * | 3/2008 | Dequina et al. | 323/316 |
| 2005/0083027 | A1 | 4/2005 | Kikuchi | |

* cited by examiner

*Primary Examiner*—Jessica Han
(74) *Attorney, Agent, or Firm*—Fogg & Powers LLC

(57) ABSTRACT

A control circuit for a DC voltage supply is provided that includes a circuit, an error amplifier and modulator. The circuit is operable to measure a voltage difference between a negative voltage rail and a ground reference in the DC voltage supply. The circuit is further operative to create an offset voltage proportional with the measured voltage difference. The circuit is further yet operative to add the offset voltage to a reference voltage to create a modified reference voltage. The error amplifier has a first input coupled to receive the modified reference voltage and a second input coupled to a positive voltage rail in the DC voltage supply. The error amplifier further has an output. The modulator is coupled to the output of the error amplifier. The modulator is operative to maintain the positive rail at a select value corresponding to the modified reference voltage.

21 Claims, 1 Drawing Sheet

CONTROL OF A DC POWER SUPPLY

RELATED CASES

The present application claims priority to and is a continuation application of U.S. application Ser. No. 11/423,479 entitled "Two Pin-Based Sensing Of Remote DC Supply Voltage Differential Using Precision Operational Amplifier And Diffused Resistors" filed on Jun. 12, 2006 which is herein incorporated by reference in its entirety.

BACKGROUND OF THE INVENTION

Power supply systems for supplying DC power to a device, such as core processors of digital processing devices, and the like, which are subject to varying load conditions, must continuously monitor the respective voltages at (remote) power supply terminals to which the powered device is coupled, in order to compensate for voltage drops associated with the resistance of the main DC output power rails and ground planes, and thereby ensure that the powered device will be continuously supplied with its intended target voltage differential. Typical monitoring and control circuits that have been employed for this purpose include three pin-based circuits.

SUMMARY OF THE INVENTION

The above-mentioned problems of current systems are addressed by embodiments of the present invention and will be understood by reading and studying the following specification. The following summary is made by way of example and not by way of limitation. It is merely provided to aid the reader in understanding some of the aspects of the invention.

In one embodiment a control circuit for a DC voltage supply is provided. The control circuit includes a circuit, an error amplifier and modulator. The circuit is operable to measure a voltage difference between a negative voltage rail and a ground reference in the DC voltage supply. The circuit is further operative to create an offset voltage proportional with the measured voltage difference. The circuit is further yet operative to add the offset voltage to a reference voltage to create a modified reference voltage. The error amplifier has a first input coupled to receive the modified reference voltage and a second input coupled to a positive voltage rail in the DC voltage supply. The error amplifier further has an output. The modulator is coupled to the output of the error amplifier. The modulator is operative to maintain the positive rail at a select value corresponding to the modified reference voltage.

BRIEF DESCRIPTION OF THE DRAWING

The single FIGURE is a schematic illustration of a two input pin-based remote differential voltage sensing architecture in accordance with a preferred embodiment of the invention.

DETAILED DESCRIPTION

Figure 1:
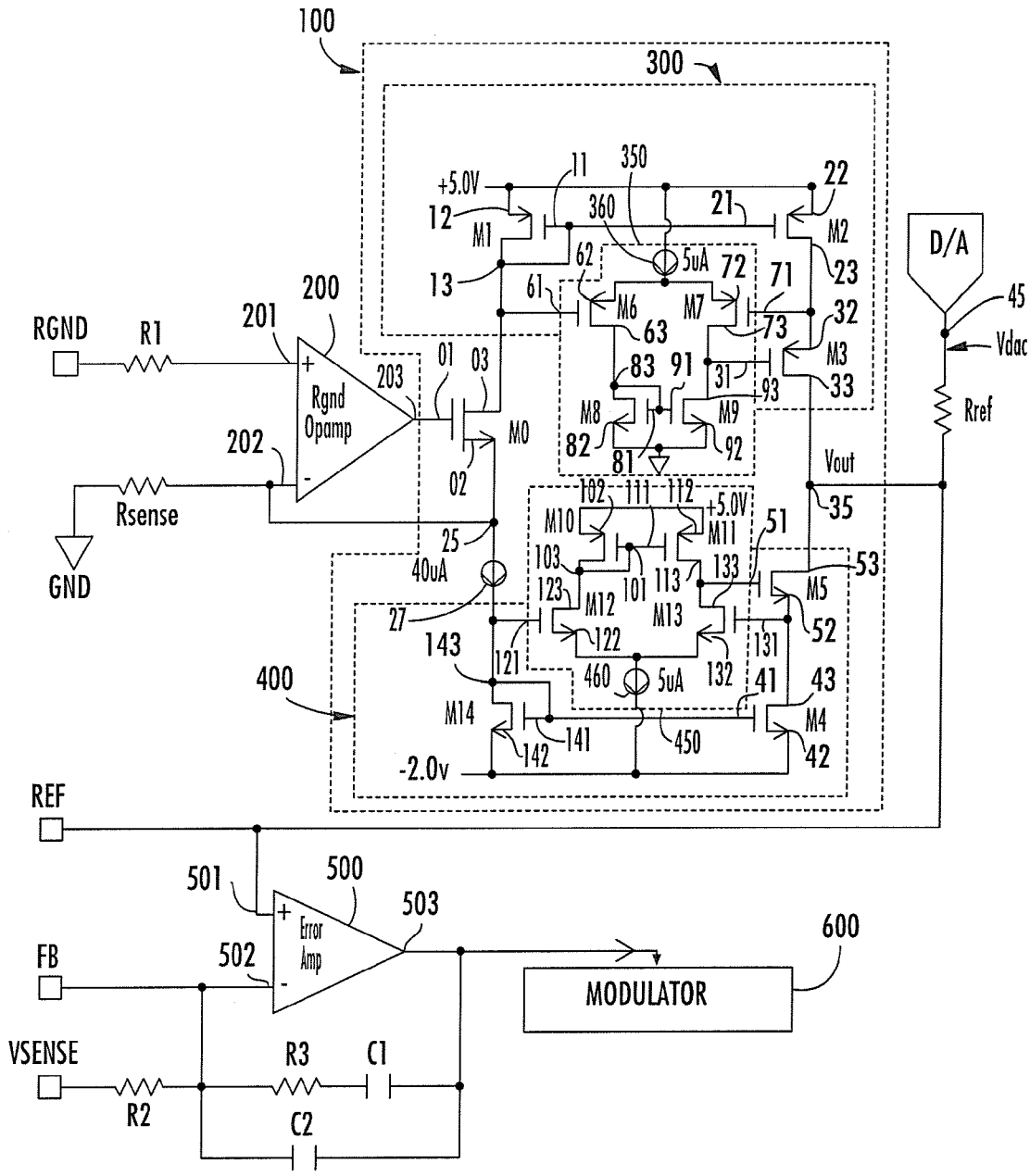

Attention is now directed to the single FIGURE, wherein a preferred embodiment of a two input pin-based remote differential voltage sensing architecture in accordance with of the present invention is schematically illustrated. As shown therein, the differential voltage sensing architecture includes a first (negative voltage rail sensing) input pin, shown as a first remote voltage sensing terminal RGND, which is adapted to be coupled to a first remote power supply terminal through which a first supply rail voltage, such as ground (GND) potential, is supplied to a first power supply terminal of the powered device, such as a core processor of a personal computer. The differential voltage sensing architecture of the invention also includes a second (positive voltage rail sensing) input pin, shown as a second remote voltage sensing terminal VSENSE, which is adapted to be coupled to a second remote power supply terminal through which a second supply rail voltage, having some prescribed DC voltage value (e.g., +3.3 VDC) that is positive relative to the first voltage (e.g., ground), is supplied to a second power supply terminal of the powered device.

The first remote voltage sensing terminal RGND is coupled through a first input resistor R1 to a first, non-inverting (+), input terminal 201 of a precision operational amplifier (op amp) 200 having a very low offset voltage. Input resistor R1 serves to provide compensation for the inherent input bias current to the op amp's input terminal 201. A second, inverting (−), input terminal 202 of the op amp is coupled through a second input resistor Rsense (which may be implemented as a diffused resistor) to a prescribed reference potential, which corresponds to the potential of the first (negative) DC power supply voltage (here ground (GND) potential).

The output 203 of op amp 200 is coupled to the control terminal (gate) 01 of a current flow control device, shown as an NMOS field effect transistor (FET) M0, of an offset current generator 100, so that the source-drain current ($Id/Ic_{M0}$) through NMOSFET M0 is controlled in accordance with the output 203 of op amp 200. The source-drain current through NMOSFET M0 serves as the input current for a current mirror input PMOSFET M1 of a first current mirror circuit 300. For this purpose, current flow control NMOSFET M0 has its drain terminal 02 coupled to the commonly connected gate and drain terminals 11 and 13, respectively, of a current mirror input PMOSFET M1, the source terminal 12 of which is referenced to a prescribed positive DC voltage (e.g., +5.0 VDC). Current mirror circuit 30 has its output coupled to an output current reference node 35, from which a voltage Vout is derived, as will be described.

The source-drain current ($Id/Ic_{M0}$) through NMOSFET M0 is derived from of the positive +5.0 VDC reference and through the source-drain path of current mirror input PMOSFET M1 to which the drain terminal 03 of NMOSFET M0 is coupled. This source-drain current is supplied to an input current reference node 25, to which the source terminal 02 of NMOSFET M0 is connected. Input current reference node 25 is coupled in common with the inverting (−) input terminal 202 of op amp 200 and with the input of a reference current source 27. Reference current source 27 is operative to supply a prescribed reference current (e.g., 40 microamps) to the commonly connected gate and drain terminals 141 and 143, respectively, of a current mirror input PMOSFET M14 of a second current mirror circuit 400, the output of which is coupled to the output current reference node 35. PMOSFET M14 has its source terminal 142 coupled to a prescribed negative DC voltage (e.g., −2.0 VDC), which serves as the sink for the reference current supplied by reference current source 27 to current mirror input PMOSFET M14.

As will be described, as long as the monitored negative voltage differential applied to the input terminals 201 and 202 of op amp 200 is balanced or zero, the output 203 of op amp 200 is zero, so that current flow control NMOSFET M0 is slightly turned on, which allows a quiescent source-drain current, corresponding to that (e.g., 40 microamps) produced by the reference current source 27, to flow therethrough from current mirror input PMOSFET M1 of the first current mirror circuit 300 to the input current reference node 25. With reference current source 27 supplying this same value of current from the input reference current node 25 for application to the input PMOSFET M14 of current mirror circuit 400, no additional current will flow into or out of the input reference current node 25 by way of the inverting (−) input terminal 202 of op amp 200, to which grounded input resistor Rsense is coupled. As a consequence, the mirrored output currents supplied by current mirror circuits 300 and 400 to the output current reference node 35 will sum to zero or match.

As will be described, this will prevent any current from flowing into or out of output current reference node 35 through an output reference resistor Rref, which is used to provide, as necessary, an offset in the reference voltage being applied to an error amplifier 500, the output of which is used to control the DC power supply's positive voltage output. However, if the sensed remote voltage at the first input terminal RGND, to which the non-inverting (+) input terminal 201 of op amp 200 is coupled by way of input resistor R1, is different from the ground reference, to which the inverting (−) input terminal 202 of op amp 200 is coupled by way of resistor Rsense, the output 203 of op amp 200 will change accordingly, so as to cause the magnitude of source-drain current flowing through NMOSFET M0 to the input current reference node 25 to be different or offset from its (40 microamps) quiescent value.

The effect of this offset in the magnitude of the source-drain current flowing through NMOSFET M0 is to cause current to flow either in a first direction—from input current reference node 25 through input resistor Rsense to ground, or in a second direction from ground—through input resistor Rsense into input current reference node 25, depending upon the polarity of the departure of the monitored negative voltage from its intended or target value (e.g., ground). Namely, any offset in the sensed negative voltage from its target value is effectively converted into an equivalent current (the current through the input resistor Rsense) that is proportional to the offset in the sensed remote voltage at the first input terminal RGND. The direction and magnitude of this equivalent current is defined by the relatively simple relationship I=V−/Rsense, and is such as to bring the voltage V− applied to the inverting (−) input terminal 202 of op amp 200 into balance with the change in sensed remote voltage coupled to op amp input terminal 201.

The change in source-drain current through NMOSFET M0 necessary to bring the voltage V− at input terminal 202 into balance with the change in the sensed remote voltage is mirrored at the output of current mirror 300, so as to cause a mismatch in the magnitudes of the mirrored output currents supplied by current mirror circuits 300 and 400 to the output current reference node 35. This, in turn, causes current to flow either out of or into the output current reference node 35 through output reference resistor Rref (depending upon whether the source-drain current through MOSFET M0 is greater or less than the reference current generated by reference current source 27). Reference resistor Rref (which, like input resistor Rsense, may be implemented as a diffused resistor) is coupled to a positive target voltage reference node 45, to which a voltage Vdac, representative of the target voltage output of the power supply, is coupled. As pointed out above, any current flow through the reference resistor Rref will cause the voltage at node 35 to change relative to the voltage Vdac, so as to change the magnitude of the reference voltage applied to the error amplifier 500, and thereby a change in the error voltage used by the power supply's modulator loop to control the power supply's positive DC output voltage.

For this purpose, the first current mirror circuit 300 includes a current mirror PMOSFET M2 coupled in current mirror configuration with input PMOSFET M1. Current mirror PMOSFET M2 has its gate 21 coupled in common with the gate 11 of PMOSFET M1, its source 22 referenced to the prescribed positive DC voltage (+5.0 VDC), and its drain 23 coupled to the source 32 of a current mirror output PMOSFET M3, the drain 33 of which is coupled to the output current reference node 35. The gate 31 of PMOSFET M3 is coupled to the drain 93 of an NMOSFET M9 and to the drain 73 of a PMOSFET M7 of a first balancing amplifier 350 comprised of cascoded MOSFETs M6-M9 which serve to provide constant drain voltages for the first current mirror circuit 300. NMOSFET M9 has its source 92 coupled to a prescribed reference potential (ground), and its gate 91 coupled in common to the gate 81 and drain 83 of an NMOSFET M8, the source 82 of which is coupled to ground. The commonly connected gate 81 and drain 83 of NMOSFET M8 are connected to the drain 63 of a PMOSFET M6, the source 62 of which is coupled in common with the source 72 of PMOSFET 70 to receive a relatively small valued (e.g., five microamps) fixed bias current supplied by a reference current source 360. PMOSFET M6 has its gate 61 coupled to the drain 13 of input PMOSFET M1, while PMOSFET M7 has its gate 71 coupled to the drain 23 of current mirror PMOSFET M2.

In a similar, but polarity-complementary manner, the second current mirror circuit 400 includes a current mirror NMOSFET M4 coupled in current mirror configuration with input NMOSFET M14. Current mirror NMOSFET M4 has its gate 41 coupled in common with the gate 141 of NMOSFET M14, its source 42 referenced to the prescribed negative DC voltage (−2.0 VDC), and its drain 43 coupled to the source 52 of a current mirror output NMOSFET M5, the drain 53 of which is coupled to the output current reference node 35. The gate 51 of NMOSFET M5 is coupled to the drain 113 of a PMOSFET M11 and to the drain 133 of an NMOSFET M13 of a second current balancing amplifier 450 comprised of cascoded MOSFETs M10-M13 which serve to provide constant drain voltages for the second current mirror circuit 400. PMOSFET M11 has its source 112 coupled to a predetermined reference potential (e.g., +5.0 VDC), and its gate 111 coupled in common to the gate 101 and drain 103 of a PMOSFET M10, the source 102 of which is coupled to +5 VDC. The commonly connected gate 101 and drain 1083 of PMOSFET M10 are connected to the drain 123 of an NMOSFET M12, the source 122 of which is coupled in common with the source 132 of NMOSFET 13 to a relatively small valued (e.g., five microamps) fixed bias current source 460. NMOSFET M12 has its gate 121 coupled to the drain 114 of input NMOSFET M14, while NMOSFET M13 has its gate 131 coupled to the drain 43 of current mirror NMOSFET M4.

The output current reference node 35, to which the drains 33 and 53 of output MOSFETs M3 and M5 of current mirrors 300 and 400 are respectively coupled, is coupled to one end of reference resistor Rref, a second end of which is coupled to positive target voltage reference node 45 which, as described above, is coupled to receive a voltage Vdac, which corresponds to the output voltage of a digital-to-analog converter (DAC) that is used to set the target value of the positive voltage of the power supply. Output current reference node 35 is further coupled to a first, non-inverting (+) input 501 of error amplifier 500. A second, inverting (−) input 502 of error amplifier 500 is coupled to a feedback node FB from the control loop of the power supply's modulator 600 and, via a resistor R2, to the second input pin or remote voltage sensing terminal VSENSE. As described briefly above, this second input pin (VSENSE) is used by error amplifier 500 to monitor a second remote power supply terminal through which a second supply rail voltage, having some prescribed DC voltage value (e.g., +3.3 VDC) that is positive relative to the first voltage (ground), is supplied to a second power supply terminal of the powered device. A compensation network 550 comprised of series connected capacitor C1 and resistor R3, that are connected in parallel with capacitor C2 is connected between the inverting (−) input 502 and the output 503 of error amplifier 500. The output 503 of error amplifier 500 provides an error voltage that is used by the power supply's modulator loop to control the power supply's positive DC output voltage.

Operation

As pointed out above, using only the two input pins RGND and VSENSE, the remote differential voltage sensing architecture of the invention continuously monitors the voltages at the positive and negative supply terminals by way of which power is supplied from the power supply to a remote utility device and adjusts or offsets, as necessary, the value of the target reference voltage applied to the error amplifier 500, so as to realize an associated adjustment of the error voltage used by the power supply's modulator loop to control the power supply's positive DC output voltage. There are three modes of operation of the circuit: 1—monitored negative voltage rail at target value; 2—monitored negative voltage rail above target value; and 3—monitored negative voltage rail below target value.

1—Monitored Negative Voltage Rail at Target Value

In this mode, the value of the (negative) voltage monitored at the first (negative voltage rail-sensing) input pin RGND, which is coupled via input resistor R1 to the non-inverting (+) input terminal 201 of op amp 200, is at its target value (here zero volts or ground potential—Corresponding to the value of the reference voltage coupled via input resistor Rsense to the inverting (−) input terminal 202 of op amp 200), so that the two inputs 201 and 202 of op amp 200 will be balanced (have a zero voltage differential therebetween). As a consequence, the output 203 of op amp is zero, so that current flow control NMOSFET M0 will be slightly turned on, as described above, to provide a prescribed quiescent source-drain current therethrough, corresponding to that (e.g., 40 microamps) produced by the reference current source 27, that flows out of the current mirror input PMOSFET M1 of the first current mirror circuit 300 and into the input current reference node 25. Since the reference current source 27, whose input is coupled to the input current reference node 25, supplies this same value of current to the input PMOSFET M14 of current mirror circuit 400, no additional current will flow into or out of the input reference current node 25 by way of the inverting (−) input terminal 202 of op amp 200, to which grounded input resistor Rsense is coupled.

As a consequence, the mirrored output currents supplied by current mirror circuits 300 and 400 to the output current reference node 35 will sum to zero, so that no additional current will flow out of or into node 35 relative to the positive target voltage reference node 45, by way of reference resistor Rref. With no current flowing (in either direction) through reference resistor Rref, there will be no associated voltage drop thereacross, so that the target positive voltage Vdac, which is representative of the target value of the positive voltage output of the DC supply, will be applied to the first, non-inverting (+) input 501 of error amplifier 500. As long as the value of the positive DC supply rail as monitored by the second input pin VSENSE is equal to its intended target value, the error out voltage from error amplifier 500 will be zero, so that the modulator's control loop will cause no change in the magnitude of the positive voltage output of DC supply. However, any difference between the value of the positive DC supply rail, as monitored by the second input pin VSENSE, from its intended target value at the positive target voltage reference node 45 and supplied therefrom to the reference input to the error amplifier 500, will cause the error amplifier 500 to generate a non-zero output or error voltage, in response to which the modulator's control loop will change the magnitude of the positive voltage output of DC supply to bring the monitored positive voltage to its intended target value.

2—Monitored Negative Voltage Rail Above Target Value

In this mode, the value of the (negative) voltage monitored at the first (negative voltage rail sensing) input pin RGND is more positive than its target value, so that the voltage at op amp input terminal 201 will be positive relative to the voltage at its input terminal 202. As a result, op amp 200 will increase the gate drive to NMOSFET M0, so as to increase the magnitude of its source-drain current being supplied to the input current reference node 25. As the magnitude of current being coupled from node 25 to the second current mirror 400 is fixed (e.g., at 40 microamps) by the reference current source 27, the increase in source-drain current into the input current reference node 25 will cause an offset current equal to that increase to flow out of node 25 and through the resistor Rsense to ground (which is at a lower potential than that of the positive voltage reference (+5 VDC) to which the input PMOSFET M1 of current mirror 300 is referenced).

This outward flow of current through resistor Rsense from the inverting (−) terminal 202 of op amp 200 to ground will cause a voltage drop across the resistor Rsense, that is effective to increase the voltage V− applied to the inverting (−) input terminal 202 of op amp 200, and thereby increase the value of the voltage V− at the inverting (−) input terminal 202 of op amp 200 toward the value of the voltage monitored at the input pin RGND and coupled to the non-inverting (+) input 201 of op amp 200. The inherent operation of operational amplifier 200 is such that the magnitude of its output (the gate drive to NMOSFET M0) will cause the resulting increase in source-drain current through NMOSFET M0 and through input resistor Rsense to bring the voltage V− at op amp input terminal 202 into balance with the positive change in the sensed remote voltage that is coupled to op amp input terminal 201.

This increase in the source-drain current through NMOSFET M0 that is necessary to bring the voltage V− at op amp input terminal 202 into balance with the change in the sensed remote voltage at op amp input terminal 201 increases the magnitude of the input current of current mirror input PMOSFET M1 of current mirror circuit 300, which is mirrored at the drain 33 of its associated current mirror output PMOSFET M3 and applied by output PMOSFET M3 to output reference current node 35. This results in a mismatch (corresponding the offset current through resistor Rsense) in the magnitudes of the mirrored output currents supplied by current mirror circuits 300 and 400 to output current reference node 35.

Because the magnitude of the current flowing into node 35 from PMOSFET M3 of current mirror circuit 300 is greater than the magnitude of the current flowing out of node 35 into NMOSFET M5 of current mirror 400, a current equal to that flowing through resistor Rsense will flow out of output current reference node 35 and through reference resistor Rref to the positive target voltage reference node 45. With current flowing through reference resistor Rref outwardly from node 35 to node 45, the resulting voltage drop across reference resistor Rref will be effective to increase the voltage Vout at node 35, relative to the voltage Vdac at the node 45. This increase in the value of the voltage Vout from its DAC-defined positive target voltage reference value supplied to node 45 will increase the value of the positive supply rail reference against which error amplifier 500 compares the positive DC supply rail as monitored by the second input pin VSENSE.

As a result, any adjustment of the positive output voltage by the DC power supply's correction loop will depend upon whether or not the monitored positive DC supply rail voltage (VSENSE) corresponds to an increased modification of the positive target value that takes into account the extent to which the negative DC supply rail has been detected to be above its target value, thereby ensuring that the intended differential between the positive and negative supply rails will be maintained.

3—Monitored Negative Voltage Rail Below Target Value

In this mode, the value of the (negative) voltage applied to the first (negative voltage rail sensing) input pin RGND is more negative than its target value, so that the voltage at op amp input terminal 201 will be negative relative to the voltage at its input terminal 202. As a result, op amp 200 will decrease the gate drive to NMOSFET M0, so as to reduce the magnitude of its source-drain current, which is supplied therethrough from current mirror input PMOSFET M1 to the input current reference node 25. Since the magnitude of current being coupled from node 25 to the second current mirror 400 is fixed (e.g., at 40 microamps) by the reference current source 27, this decrease in the amount of source-drain current through NMOSFET M0 into the input current reference node 25 will cause an offset current, that equal to the decrease in the magnitude of source-drain current through NMOSFET M0, to from ground through the resistor Rsense and into node 25. This inward flow of current through resistor Rsense from ground toward inverting (−) input terminal 202 of op amp 200 will cause a voltage drop across resistor Rsense, that is effective to decrease the voltage V− applied to the inverting (−) input terminal 202 of op amp 200. The inherent operation of operational amplifier 200 is such that the magnitude of its output (the gate drive to NMOSFET M0) will cause the resulting decrease in source-drain current through NMOSFET M0 and through input resistor Rsense to bring the voltage V− at op amp input terminal 202 into balance with the negative change in the sensed remote voltage that is coupled to op amp input terminal 201.

This decrease in the source-drain current through NMOSFET M0 that is necessary to bring the voltage V− at op amp input terminal 202 into balance with the negative change in the sensed remote voltage at op amp input terminal 201 decrease the magnitude of the input current of current mirror input PMOSFET M1 of current mirror circuit 300, which is mirrored at the drain 33 of its associated current mirror output PMOSFET M3 and applied by output PMOSFET M3 to output reference current node 35. This results in a mismatch (corresponding the offset current through resistor Rsense) in the magnitudes of the mirrored output currents supplied by current mirror circuits 300 and 400 to output current reference node 35.

Because the magnitude of the current flowing into node 35 from PMOSFET M3 of current mirror circuit 300 is less than the magnitude of the current flowing out of node 35 into NMOSFET M5 of current mirror 400, a current equal to that flowing through resistor Rsense will flow inwardly from the positive target voltage reference node 45 through reference resistor Rref and into the output current reference node 35. With current flowing through reference resistor Rref inwardly from node 45 to node 35, the resulting voltage drop across reference resistor Rref will be effective to decrease the voltage Vout at node 35, relative to the voltage Vdac at the node 45. This decrease in the value of the voltage Vout from its DAC-defined positive target voltage reference value supplied to node 45 will reduce the value of the positive supply rail reference against which error amplifier 500 compares the positive DC supply rail as monitored by the second input pin VSENSE.

As a result, any adjustment of the positive output voltage by the DC power supply's correction loop will depend upon whether or not the monitored positive DC supply rail voltage (VSENSE) corresponds to a decreased modification of the positive target value that takes into account the extent to which the negative DC supply rail has been detected to be lower its target value, thereby ensuring that the intended differential between the positive and negative supply rails will be maintained.

As will be appreciated from the foregoing description, by using a relatively simple circuit implementation (operational amplifier-controlled current mirror circuit) to monitor a single input pin coupled to a first (negative) power supply rail, through which a relatively negative one (e.g., ground) of a pair of supply rail voltages (such as ground and a positive DC voltage) is supplied to a positive supply terminal for the powered device, the two input pin-based DC power supply control circuit architecture of the present invention readily derives a current representative of the voltage differential between the negative supply rail and its target voltage. This derived current is then used to modify the input current to a current mirror circuit, whose mirrored output current is coupled through an output reference resistor, to produce an offset voltage of a magnitude and polarity that is defined in accordance with the magnitude and polarity of the derived current.

This offset voltage is added to or subtracted from a reference voltage for an error amplifier, to which a second input pin that monitors the second, relatively positive one of the pair of supply rail voltages is applied. The output of the error amplifier is then used by the power supply's modulator loop to adjust the power supply output. Because any adjustment of the positive output voltage by the DC power supply's correction loop not only depends upon whether or not the positive DC supply rail is at its target value, but whether or not the negative DC supply rail is at its target value, the invention readily ensures that the intended differential between the positive and negative supply rails will maintained.

While we have shown and described an embodiment in accordance with the present invention, it is to be understood that the same is not limited thereto but is susceptible to numerous changes and modifications as known to a person skilled in the art, and we therefore do not wish to be limited to the details shown and described herein, but intend to cover all such changes and modifications as are obvious to one of ordinary skill in the art.

What is claimed is:

1. A method of adjusting a DC power supply output, the method comprising:

comparing a voltage at a negative terminal input to a device with a target voltage at the negative terminal input to obtain an offset voltage;

producing an error amplifier reference voltage based on the offset voltage and a target value of a voltage on a positive terminal input to the device;

comparing the error amplifier reference voltage with a voltage of the positive terminal to the device to produce an error voltage; and adjusting a positive output voltage of the power supply to the positive terminal based on the error voltage so as to maintain an intended voltage differential between the negative terminal input and the positive terminal input.

2. The method of claim 1, wherein comparing the voltage at the negative terminal input to the device with the target voltage to obtain the offset voltage further comprises:

based on the comparison, producing an offset current representative of a voltage differential between the voltage at the negative terminal input and the target voltage at the negative terminal input; and using the offset current to produce the offset voltage.

3. The method of claim 1, wherein producing the error amplifier reference voltage based on the offset voltage and the target value of the voltage on the positive terminal input to the device further comprises:

adding the offset voltage to the target value of the voltage at the positive terminal input.

4. The method of claim 1, wherein producing the error amplifier reference voltage based on the offset voltage and the target value of the voltage on the positive terminal input to the device further comprises:

subtracting the offset voltage to the target value of the voltage at the positive terminal input.

5. The method of claim 1, farther comprising:

implementing one of a first-monitored negative rail at target value mode of operation, a second-monitored negative voltage rail above target value mode of operation and a third-monitored negative voltage rail below target value mode of operation.

6. The method of claim 5, wherein the first-monitored negative rail at target value mode of operation further comprises:

when the voltage on the positive terminal is equal to its intended target, maintaining the magnitude of the positive voltage output of the DC power supply; and when the voltage on the positive terminal is not equal to its intended target, changing the magnitude of the positive voltage output of the DC power supply to bring the positive voltage to its intended target.

7. The method of claim 5, wherein the second-monitored negative voltage rail above target value mode of operation further comprises:

increasing the value of the error amplifier reference voltage.

8. The method of claim 5, wherein the third-monitored negative voltage rail below target value mode of operation further comprises:

decreasing the value of the error amplifier reference voltage.

9. A control circuit for a DC voltage power supply, the control circuit including, an operational amplifier having a first input coupled to a negative voltage rail of the power supply, a second input coupled to a ground reference and an output, an offset current generator operative to generate an offset current at an output reference node representative of the voltage differential between the negative voltage rail and the ground reference based on the output of the operational amplifier, an error amplifier having a first input coupled to the output reference node, a second input coupled to a positive voltage rail of the power supply, and an error amplifier output; and a modulator coupled to the error amplifier output operative to maintain the positive voltage rail at a select value.

10. The control circuit of claim 9, wherein the offset current generator further comprises:

a current flow device operable based on the an output of the operational amplifier;

a first current mirror circuit operable based on the current flow device to generate a first output mirror current at the output reference node; and a second mirror circuit in a polarity complementary manner to the first current mirror circuit operable based on the current flow device to generate a second output mirror current at the output reference node.

11. The control circuit of claim 9, further comprising:

a digital/analog (D/A) converter to provide a voltage; and a reference voltage resistor coupled between the D/A converter and the output reference node.

12. The control circuit of claim 9, further comprising:

an input resistor coupled to the first input of the of the operational amplifier to provide compensation for inherent input bias current.

13. The control circuit of claim 9, further comprising:

a sense resistor coupled to the second input of the operational amplifier.

14. The control circuit of claim 13, wherein the sense resistor is a diffused resistor.

15. A DC power supply with a control apparatus, the power supply comprising:

a negative voltage rail to supply ground reference to a device;

a positive voltage rail to supply a positive voltage to the device;

a control circuit configured to control the voltage level on the positive voltage rail, the control circuit including, an operational amplifier having a first input coupled to the negative voltage rail, a second input coupled to a ground reference and an output, an offset current generator operative to generate an offset current at an output reference node representative of the voltage differential between the negative voltage rail and the ground reference based on the output of the operational amplifier, an error amplifier having a first input coupled to the output reference node, a second input coupled to the positive voltage rail, and an error amplifier output; and a modulator coupled to the error amplifier output operative to maintain the positive voltage rail at a select value.

16. The power supply of claim 15, wherein the offset current generator further comprises:

a current flow device operable based on the an output of the operational amplifier;

a first current mirror circuit operable based on the current flow device to generate a first output mirror current at the output reference node; and a second mirror circuit in a polarity complementary manner to the first current mirror circuit operable based on the current flow device to generate a second output mirror current at the output reference node.

17. The power supply of claim 15, further comprising:

a digital/analog (D/A) converter to provide a voltage; and a reference voltage resistor coupled between the D/A converter and the output reference node.

18. The power supply of claim 15, further comprising:

a feedback node coupled to the second input of the error amplifier, the feedback node further coupled to a control loop of the modulator.

19. The power supply of claim 15, further comprising:

a compensation network coupled between the second input of the error amplifier and the error amplifier output.

20. The power supply of claim 19, wherein the compensation network comprises:

a resistor;

a first capacitor coupled in series with the resistor; and a second capacitor coupled in parallel with the resistor and the first capacitor.

21. A control circuit for a DC voltage supply, the control circuit comprising:

a circuit operable to measure a voltage difference between a negative voltage rail and a ground reference in the DC voltage supply, the circuit further operative to create an offset voltage proportional with the measured voltage difference, the circuit further yet operative to add the offset voltage to a reference voltage to create a modified reference voltage;

an error amplifier having a first input coupled to receive the modified reference voltage and a second input coupled to a positive voltage rail in the DC voltage supply, the error amplifier further having a output; and a modulator coupled to the output of the error amplifier, the modulator operative to maintain the positive rail at a select value corresponding to the modified reference voltage.

* * * * *